US005116392A

United States Patent [19]

Selgrad et al.

[11] Patent Number: 5,116,392

[45] Date of Patent: May 26, 1992

[54] ABRASIVE ARTICLE AND ABRASIVE

[75] Inventors: Volker Selgrad, Natters; Friedrich Sladky, Innsbruck, both of Austria

[73] Assignee: Tyrolit - Schleifmittelwerke Swarovski K.G., Schwaz, Austria

[21] Appl. No.: 457,953

[22] Filed: Dec. 27, 1989

[30] Foreign Application Priority Data

Dec. 30, 1988 [EP] European Pat. Off. ..... 88121884.6
Jun. 21, 1989 [EP] European Pat. Off. ..... 89111276.5

[51] Int. Cl.[5] ..... B24D 3/02

[52] U.S. Cl. ..... 51/309; 51/298; 51/307

[58] Field of Search ..... 51/298, 307, 309

[56] References Cited

U.S. PATENT DOCUMENTS

| | | | |
|---|---|---|---|
| 4,253,850 | 3/1981 | Rue et al. | 51/298 |
| 4,350,497 | 9/1982 | Ogman | 51/298 |
| 4,381,188 | 4/1983 | Waizer et al. | 51/309 |
| 4,381,925 | 5/1983 | Colleselli | 51/309 |
| 4,472,173 | 9/1984 | Brüning et al. | 51/309 |
| 4,541,843 | 9/1985 | Elbel et al. | 51/298 |

*Primary Examiner*—William R. Dixon, Jr.
*Assistant Examiner*—Willie J. Thompson
*Attorney, Agent, or Firm*—Wenderoth, Lind & Ponack

[57] ABSTRACT

An abrasive article with abrasive grain such as corundum, a binder which is a hardenable organic or inorganic system, for example plastic, such as phenol resin, and grinding-active fillers, as well as an abrasive with abrasive grain such as corundum, a binder which is a hardenable organic or inorganic system, for example plastic, such as phenol resin, and grinding-active fillers. The abrasive compound of the abrasive consisting of abrasive grain, binder and the fillers is placed on a flexible substrate, which is formed by a nonwoven fabric. New low-priced fillers with low toxicity are incorporated in the abrasive article and, in fact, metal complex salts with the following structure:

$$uM_1 \cdot vM_2 \cdot wHal \cdot xChal \cdot zPh$$

where:

$M_1$ = pure metal or mixture of alkali metal, alkaline earth metal and/or Al $M_2$ = pure metal or mixture of Zn, Mn, Fe except for Fe as chloride Hal = pure halogen or mixture of F, Cl, Br, I Chal = chalcogenides, O and/or S Ph = phosphate or more highly condensed phosphates $P_rO_s$(r = 1 to 10, preferably 1 to 2, s = 4 to 20, preferably 4 to 7)

u, v, w, x or z = 0 to 95%, and the total of u and v = 1 to 95%, preferably 20 to 80%, and the total of w, x and z = 1 to 95%, preferably 20 to 80%, and that the total of u, v, w, x and z is 100%. These fillers are melted or sintered with each other.

32 Claims, No Drawings

ABRASIVE ARTICLE AND ABRASIVE

The invention relates to an abrasive article with abrasive grain such as corundum, a binder which is a hardenable organic or inorganic system, for example plastic such as phenol resin, and fillers which are at least partly grinding-active.

The invention also relates to an abrasive with a flexible substrate, the abrasive element and at least partly grinding-active fillers being held on the substrate by a binder, for example phenol resin.

The use of fillers in abrasive articles is known. In this connection, the term fillers in the abrasives industry comprises the following three terms in practice:

1. Fillers in the classical or standard sense for filling of plastics.

These have the following effects:

a) Economy of resin and thus lowering of the cost of the resin system and thus of the abrasive article.

b) Strengthening effects (reinforcing effect) and thus an increase of the strength of the binding web between the abrasive grains. This produces an increase of the "bursting value" (circumferential velocity at break), of the abrasive hardness, the side stiffness, etc. of the abrasive element.

c) Lowering of the strength of the binding web and thus attainment of a softer bonding material and of gentler abrasion. Blunted abrasive grains break out more easily and the self-sharpening properties of the abrasive element are improved, but the wheel wear also increases.

For many fillers, effects a) and b) or a) and c) occur together. Examples of such fillers are: wood flour, coconut-shell flour, rock flour, chalk, clay, feldspar, kaolin, quartz, short glass fibers, glass beads (Bellotini), surface-treated fine grain (silicon carbide, corundum, etc.), pumice stone, cork dust, etc. A feature common to these fillers is that they are "grinding-inactive", i.e., that no chemical and physical reactions that positively influence the abrasion process occur during this process.

2. Fillers that influence the processing process, especially the thermal hardening of the plastic resins, e.g., magnesium oxide, calcium oxide.

3. "Grinding-active fillers". During the grinding process these cause chemical and physical processes that positively influence the abrasive behavior. In particular, these fillers are intended to bring about increases in the service life of the grinding machine and reduction of the heating of workpiece and abrasive article and thus the prevention of thermal disintegrations, especially in dry grinding. For many materials that are difficult to work by material-removing techniques, e.g., unalloyed, low-carbon steels or titanium, these fillers are the prerequisite for economic machining.

Obviously the grinding-active fillers can also have effects of the fillers mentioned under 1. and 2. (increase or reduction of the strength, influence on the hardening process, etc.).

In addition to the cited fillers, there are also additives in the grinding tool, which additives either cause improved adhesion of the abrasive grain in the bonding material (coupling agents, e.g., silanes or coupling coatings, e.g., frits with melted metallic oxide ceramic coatings or the like.

Other additives cause, for example, facilitated fabrication, in that they either improve the free-flowing ability of the abrasive compound or lower the internal friction during compaction. pressing. Except in special cases, these additives have no influence in the grinding process.

The most important fillers in compounds for abrasive wheels are the grinding-active fillers. Their effects can generally be subdivided into the following three main groups:

1. Reduction of the friction between abrasive grain, workpiece and swarf, i.e., the fillers or their secondary products must act as high-temperature and high-pressure lubricants. For this purpose they can form a primary lubricant film in the form of a melted film (e.g., cryolite) or a solid lubricant film (graphite, molybdenum sulfide, lead oxide). However, secondary films can also be formed: metal chloride (sulfide) as the filler→ splitting-off of chlorine (sulfur)→metal chloride of the ground material.

2. Protective effects by forming primary or secondary surface films on grain, workpiece and swarf (analogous to point 1.). Thereby grain disintegrations due to diffusion processes (e.g., spinel formation during grinding of ferrous materials with corundum), built-up edges on the grain and rewelding effects (swarf and material) are prevented.

3. Cooling effects in the micron region due to high heats of melting, evaporation and transformation and to thermal transformation points that are favorably situated on the temperature scale.

Examples of substances that have proved to be particularly grinding-active are halides (e.g., lead chloride, fluorspar, cryolite, etc.), chalcogenides (e.g., pyrites, antimony sulfides, zinc sulfide, molybdenum sulfide, selenides, tellurides, etc.), low-melting metals (e.g., lead, tin, low-melting composition metals) and high-pressure lubricants (e.g., graphite, boron nitride).

The best fillers in practice with regard to wheel service life and low grinding temperature ("cool" grinding) have proved to be lead chloride and antimony trisulfide.

It has been found that a filler is all the more grinding-active the lower its transformation temperature are (melting, boiling, sublimation, decomposition points) and the better the lubricant films it forms at grinding temperatures. Obviously these temperatures are limited on the low side by the processing conditions during manufacture of the abrasive articles. In addition, because of decomposition during the grinding process, chemically highly active elements or compounds should be liberated, e.g., elemental chlorine, hydrogen chloride, sulfur, sulfur dioxide, etc.

In practice, however, numerous substances are unusable or are usable only subject to special prerequisites, because they are expensive (noble metal halides, molybdenum sulfide) or toxic (arsenic, selenium, lead compounds), because they reduce the wheel strength (e.g., graphite, sulfur) or because they are hygroscopic or at least readily water-soluble (numerous chlorides) or react strongly with the unhardened phenol-resin system (hygroscopic chlorides).

In summary, therefore, it can be stated that an optimum grinding-active filler must have favorable transformation temperatures, favorable film-forming properties and chemically reactive elimination products, that it and its secondary products should have the lowest possible toxicity and thus high (maximum permissible workplace concentrations), that it should be inexpensive and that its processing to abrasive articles must be possible. Furthermore, the strength and grinding properties must be retained even under unfavorable storage conditions (high temperature and humidity).

The object of the invention is to provide new grinding-active fillers at a lower price, which are characterized by low toxicity and high maximum permissible workplace concentrations.

From Austrian Patent 366,944 of the applicant, the use of hygroscopic fillers is known which have very good grinding-active properties. The disadvantage of these fillers is that in practice they must be coated, which on the one hand is laborious and thus expensive and on the other hand, because of the coating, the volume of the grinding-active fillers that can be incorporated into the abrasive compound is reduced.

A special object of the invention is to incorporate, in an abrasive element of the initially mentioned type, fillers that have the same effect as toxic fillers, e.g., lead, and also the grinding-active cooling properties of hygroscopic fillers, e.g., $ZnCl_2$, without being hygroscopic in this case.

The grinding rate of the abrasive (material removal per unit time on flexible substrate) and the surface quality of the workpiece achieved therewith change with the degree of wear of the abrasive. For numerous applications of abrasives with flexible substrate, the surface quality is a more important consideration than the material-removing rate. In grinding, the blunting of the abrasive elements increases and the peak-to-valley height decreases. Moreover, the service life of the abrasives represents an important cost and quality factor.

Various suggestions have become known for improving the material-removing rates and the service lives of the abrasive as well as the surface quality of the workpiece. In particular, it has been sought to obtain a surface peak-to-valley height that remains substantially constant over a long time.

The flexible substrates of such an abrasive are formed mostly from woven fabric, paper or a nonwoven fabric. Mostly corundum is employed as the abrasive grain, in which connection it is known that both individual grains and abrasive-grain agglomerates can be used. Phenol resin, for example, is employed as the binder.

For numerous practical applications, the abrasives on substrates tend to become "lined" by the swarf removed from the workpiece. This leads to a decrease of the material-removing rate, deterioration of the workpiece surface and, under some circumstances, failure of the grinding machine.

Although abrasives on substrates generally grind cooler than bonded abrasives (abrasive wheels), damage to the workpiece surface (e.g., cracking, discoloration) can occur in the case of sensitive workpieces at high material-removing rate.

Furthermore, it is important to improve the active cutting case of the abrasive grains of the abrasive, since these wear relatively rapidly (in general, the abrasives on substrates have only one layer of grain), whereas the abrasive substrate remains fully intact over a much longer period of employment. In the case of prematurely worn abrasives, therefore, an economically significant proportion must be discarded unused.

In the past, attempts have been made to achieve optimization of the abrasive properties of an abrasive by appropriate choice of abrasive grain, by special arrangement of the abrasive grain and/or by mixing fillers into the binder matrix. The so-called grinding-active fillers in particular are used to improve the abrasive property. During the grinding process these cause chemical and physical processes which positively influence the abrasive and wear behavior. In particular, these fillers are supposed to bring about an increase of service life and material-cutting rate as well as a reduction of the grinding temperatures and of the degree of lining.

A further object of the invention is to provide new grinding-active fillers for an abrasive with a flexible substrate at a lower price, which fillers are characterized by low toxicity, low hygroscopicity and high maximum permissible workplace concentrations.

A special object of the invention is, in an abrasive of the initially mentioned type, to incorporate fillers that have the same effect as toxic fillers, e.g., lead compound, as well as the grinding-active, cooling properties of hygroscopic fillers, e.g., $ZnCl_2$, without being hygroscopic in this case.

The abrasive article according to the invention and the abrasive according to the invention are characterized by the fact that at least part of the grinding-active fillers are metal complex salts with the following structure:

$$uM_1 \cdot vM_2 \cdot wHal \cdot xChal \cdot zPh$$

$M_1$ = pure metal or mixture of alkali metal, alkaline earth metal and/or Al $M_2$ = pure metal or mixture of Zn, Mn, Fe except for Fe as chloride Hal = pure halogen or mixture of F, Cl, Br, I Chal = chalcogenide O (oxygen) and/or S (sulfur)

Ph = phosphate or more highly condensed phosphates $P_rO_s$ (r = 1 to 10, preferably 1 to 2, s = 4 to 20, preferably 4 to 7)

u, v, w, x or z = 0 to 95%, and the total of u and v = 1 to 95%, preferably 20 to 80%, and the total of w, x and z = 1 to 95%, preferably 20 to 80%, that the total of u, v, w, x and z is 100%, and that these fillers are melted or sintered with each other.

The indicated precentages here and in the following description are weight percents unless expressly indicated otherwise.

According to the invention, chlorides are provided that are not hygroscopic. Expensive protective steps such as coating with organic substances can therefore be dispensed with. This also introduces the advantage, as already mentioned, that more grinding-active filler per unit mass is present in the abrasive compound. Because of the limited binding capacity and quantity of phenol resin, it is not possible to bind unlimited amounts of fillers into the abrasive compound. Thus the volume of the grinding-active fillers in the abrasive wheel is reduced by coating.

Practical examples of the invention are described in the following.

The filler according to the invention is first described in its use in a conventional phenol-resin-bonded cutting-off abrasive wheel with corundum as the abrasive grain. In the practical example according to the invention, three metal salts were melted together, pulverized and screened in order to make the filler according to the invention, and, in fact, the salts were melted and the molten liquid was cast on a metal slab, where it cooled very rapidly and, after hardening, the mixture was pulverized in order to form the new filler.

The preferred abrasive mix for a cutting-off abrasive wheel for cutting of structural steel is a mix of 70 weight percent of KCl and 10 weight percent of ZnS and 10 weight percent of MnS. The particles were melted. The compound after melting and hardening on a steel slab was pulverized in a cross beater mill and screened to a fineness of 240 mesh, US Standard (63 micron).

Three cutting-off wheels were made.

A first wheel was made in which lead chloride ($PbCl_2$) was used in conventional manner as the only grinding-active filler. This abrasive wheel was the reference abrasive wheel in comparison with which the results of the other abrasive wheels were measured.

A second abrasive wheel was also made in conventional manner, $K_2MnCl_4$ being incorporated as a hygroscopic, nontoxic, active filler.

A third cutting-off wheel was provided with the above-described filler according to the invention.

The cutting-off wheels were made as described below. The compound for the binder used in these three cutting-off wheels consisted of phenol resin and the fillers. The phenol resin was divided up. 82 volume percent of the total phenol resin was used in the form of a novolak hexa mixture and the rest in the form of a liquid resol.

First of all the binder mix was prepared, which consists of the dry resin powder and the fillers. The compositions of the binder mixes for the three wheels were the following:

TABLE I

| Material | Binders with filler 1st wheel | 2nd wheel | 3rd wheel |
|---|---|---|---|
| Phenol resin powder | 100.0 | 100.0 | 100.0 |
| $PbCl_2$ | 75.2 | — | — |
| $K_2MnCl_4$ | — | 52.1 | — |
| Molten mix of 4 KCl.MnS.ZnS | — | — | 48.5 |

(Numbers in weight units)

Dry binder mixes were prepared by mixing the above-mentioned constituents.

The next step was the preparation of an abrasive-wheel mix of corundum, liquid resin and the binder mix. The abrasive-wheel mix for the three cutting-off wheels is indicated below.

TABLE II

| Material | 1st wheel | 2nd wheel | 3rd wheel |
|---|---|---|---|
| Corundum | 74.41 | 74.69 | 74.77 |
| Liquid phenol resol | 2.34 | 2.35 | 2.35 |
| Pulverulent bonding material | 23.25 | 22.96 | 22.88 |

The abrasive-wheel mix was prepared by introducing the corundum into a mixer. The liquid phenol resol was poured onto the corundum and the mixer was run until the corundum grains were coated with the liquid resol. The premixed, pulverulent binder mix was introduced into a second mixer and the abrasive grain wetted with liquid resin was mixed in until all abrasive grains were covered with a coat. The mix was then screened in order to remove agglomerates and aged for twelve hours. The aged mix was pressed into wheels with a diameter of 600 mm and a thickness of 7.5 mm. Two reinforcing woven fabrics of type 93160 were interposed into each wheel. The wheels were then hardened for 36 hours, the maximum temperature of 175° being maintained for six hours. The hardened wheels were subjected to a bursting test and inspected for unbalance and dimensions. All wheels were in compliance with the standard values.

The grinding tests were performed on a Rico cutting-off machine at a circumferential velocity of 80 m/sec. CK-45 structural steel with a cross section of 80×80 mm was cut. 20 cuts were made with each cutting-off wheel. The cutting-off rate was 6.4 $cm^2$/sec. The wheel wear and the grinding rate were measured. The performance factor G was calculated as $$\text{abrasion ratio} = \frac{\text{cut-off material cross section}}{\text{area wear of the wheel}}$$

The grinding results of these three cutting-off wheels are presented in Table III.

TABLE III

| Wheel No. | Filler mix | Performance factor G | Discoloration | Cutting-off rate $cm^2$/sec | Hygroscopicity |
|---|---|---|---|---|---|
| 1st wheel | $Pb\ Cl_2$ | 100% | blank | 6.4 | not hygroscopic |
| 2nd wheel | $K_2MnCl_4$ | 70% | blank | 6.4 | hygroscopic |
| 3rd wheel | 4 KCl. MnS.ZnS | 95% | blank | 6.4 | not hygroscopic |

Further examples for filler formulations according to the invention are the following:

Examples: 4 KCl.ZnS
4 KCl.MnS
6 KCl.MnS.$Zn_2P_2O_7$
4 KCl.$Zn_2P_2O_7$
6 KCl.ZnS.$MnCl_2$.$Zn_2P_2O_7$ As the table shows, with the filler according to the invention there are obtained performance factors equivalent to lead chloride with the same cutting quality and with results that are about 36% better than with hygroscopic manganese fillers.

A practical example of an abrasive is described in the following:

The filler according to the invention is described in its use with conventional phenol-resin-bonded corundum as the abrasive grain. The abrasive compound rests on a flexible substrate, for example a woven fabric. In the practical example according to the invention, three metal salts were mixed with each other, pulverized and screened in order to make the filler according to the invention, and, in fact, the salts were melted and the molten liquid was cast on a metal slab, where it cooled very rapidly and, after hardening, the mixture was pulverized with a cross beater mill in order to form the new filler. Thereafter the particles were screened to a fineness of 240 mesh, U.S. Standard (63 micron). Abrasive strips with woven-fabric substrate were made in a conventional manner, in which process these strips were provided on the one hand with the new grinding-active fillers, while on the other hand standard fillers (kaolin, fluorspar, lithopone, chalk) were used.

Three samples of the flexible abrasive element were prepared.

A first sample was prepared in which potassium tetrafluoroborate ($KBF_4$) was used in the conventional way as the only grinding-active filler. This abrasive article was the reference abrasive article, in comparison with which the results of the other abrasive articles were measured.

Two further samples were provided with the above-described fillers according to the invention, the filler being incorporated in the cover binder coat.

A ground binder coat of an aqueous phenol resin was deposited on a cloth support material. Thereafter synthetic corundum of P46 grain size was deposited, in a proportion of about 640 g/m$^2$.

After hardening of the ground binder and fixation of the abrasive grain, a cover binder coat was deposited, this cover binder coat containing in sample I: $KBF_4$ in sample II: 4 KCl MnS ZnS and in sample III: $Zn_2P_2O_7$. KCl zinc pyrophosphate and potassium chloride.

The coating density of the cover coat was 115 g/m$^2$ in all three samples.

Comparison grinding with the prepared abrasive strips was performed on a testing machine.

The testing machine operated at a grinding speed of 12 m/sec. The quantity ground off was measured after a grinding time of 60 minutes. The result for sample I was defined as 100%, and samples II and III were set in relationship thereto.

Table 1 shows that the effectiveness of fillers II and III is respectively 20% and 27% better than that of the standard filler.

TABLE 1

| Sample % | Filler | Performance |
|---|---|---|
| 1 | $KBF_4$ | 100% |
| 2 | 4 KCl.MnS.ZnS | 120% |
| 3 | $Zn_2P_2O_7$.KCl | 127% |

According to the invention, the filler could also be disposed in a third binder coat.

We claim:

1. An abrasive article comprising abrasive grains, a binder which is a hardenable organic or inorganic system, and fillers which are at least partly grinding-active, wherein at least part of the grinding-active fillers are metal complex salts with the following structure:

$$uM_1 \cdot vM_2 \cdot wHal \cdot xChal \cdot zPh$$

in which $M_1$ is one or more members selected from the group consisting of an alkali metal, an alkaline earth metal and Al, $M_2$ is one or more members selected from the group consisting of Zn, Mn and Fe, Hal is one or more members selected from the group consisting of F, Cl, Br and I, Chal is one or more members selected from the group consisting of O and S, Ph is a phosphate or more highly condensed phosphate of the formula $P_rO_s$ where r is 1 to 10 and s is 4 to 20, each of u, v, w, x and z is 1 to 95%, and the total of u and v is 1 to 95%, and the total of w, x and z is 1 to 95%, wherein the total of u, v, w, x and z is 100% , and wherein the fillers are melted or sintered with each other.

2. An abrasive article according to claim 1, wherein $M_1$ is Li, Na, K, Mg, Ca or Al.

3. An abrasive article according to claim 1, wherein $M_2$ is Zn, Mn or Fe.

4. An abrasive article according to claim 1, wherein Hal is F or Cl.

5. An abrasive article according to claim 1, wherein Chal is O or S.

6. An abrasive article according to claim 1, wherein Ph is $PO_4$ or $P_2O_7$.

7. An abrasive article according to claim 1, wherein the grinding-active fillers are metal complex salts with the following structure:

$$mKCl \cdot nMnS \cdot pZn_2P_2O_7$$

where m, n, p=1 to 95% and the total of m, n and p is 100%.

8. An abrasive article according to claim 1, wherein the grinding-active fillers are metal complex salts with the following structure:

$$mKCl \cdot nZnS \cdot pMn_2P_2O_7$$

where m, n, p=1 to 95%.

9. An abrasive article according to claim 1, wherein the grinding-active fillers are metal complex salts with the following structure:

$$mKCl \cdot nMnS$$

where m, n=1 to 95%.

10. An abrasive article according to claim 1, wherein the grinding-active fillers are metal complex salts with the following structure:

$$mKCl \cdot nZnS$$

where m, n=1 to 95%.

11. An abrasive comprising a flexible substrate, abrasive grains and at least partly grinding-active fillers held on the substrate by a binder, wherein at least part of the grinding-active fillers are metal complex salts with the following structure:

$$uM_1 \cdot vM_2 \cdot wHal \cdot xChal \cdot zPh$$

in which $M_1$ is one or more members selected from the group consisting of an alkali metal, an alkaline earth metal and Al, $M_2$ is one or more members selected from the group consisting of Zn, Mn and Fe, Hal is one or more members selected from the group consisting of F, Cl, Br and I, Chal is one or more members selected from the group consisting of O and S, Ph is a phosphate or more highly condensed phosphate of the formula $P_rO_s$ where r is 1 to 10 and s is 4 to 20, each of u, v, w, x and z is 1 to 95%, and the total of u and v is 1 to 95%, and the total of w, x and z is 1 to 95%, wherein the total of u, v, w, x and z is 100%, and wherein the fillers are melted or sintered with each other.

12. An abrasive according to claim 11, wherein $M_1$ is Li, Na, K, Mg, Ca or Al.

13. An abrasive according to claim 11, wherein $M_2$ is Zn, Mn or Fe.

14. An abrasive according to claim 11, wherein Hal is F or Cl.

15. An abrasive according to claim 11, wherein Chal is O or S.

16. An abrasive according to claim 11, wherein Ph is $PO_4$ or $P_2O_7$.

17. An abrasive according to claim 11, wherein the grinding-active fillers are metal complex salts with the following structure:

$$mKCl \cdot nMnS \cdot pZn_2P_2O_7$$

where m, n, p=1 to 95% and the total of m, n and p is 100%.

18. An abrasive according to claim 11, wherein the grinding-active fillers are metal complex salts with the following structure:

$$mKCl \cdot nZnS \cdot pMn_2P_2O_7$$

where m, n, p=1 to 95%.

19. An abrasive according to claim 11, wherein the grinding-active fillers are metal complex salts with the following structure:

$$mKCl \cdot nMnS$$

where m, n=1 to 95%.

20. An abrasive according to claim 11, wherein the grinding-active fillers are metal complex salts with the following structure:

$$mKCl \cdot nZnS$$

where m, n=1 to 95%.

21. An abrasive article according to claim 1, wherein the abrasive grains are corundum.

22. An abrasive article according to claim 1, wherein the binder is a plastic.

23. An abrasive article according to claim 22, wherein the binder is a phenol resin.

24. An abrasive article according to claim 1, wherein r is 1 to 2 and s is 4 to 7.

25. An abrasive article according to claim 1, wherein the total of u and v is 20 to 80% and the total of w, x and z is 20 to 80%.

26. An abrasive article according to claim 9, wherein each of m and n is 20 to 80%.

27. An abrasive article according to claim 10, wherein each of m and n is 20 to 80%.

28. An abrasive according to claim 11, wherein the binder is a phenol resin.

29. An abrasive according to claim 11, wherein r is 1 to 2 and s is 4 to 7.

30. An abrasive according to claim 11, wherein the total of u and v is 20 to 80% and the total of w, x and z is 20 to 80%.

31. An abrasive according to claim 19, wherein each of m and n is 20 to 80%.

32. An abrasive according to claim 20, wherein each of m and n is 20 to 80%.

* * * * *